US011072751B1

(12) United States Patent
Koseoglu

(10) Patent No.: US 11,072,751 B1
(45) Date of Patent: Jul. 27, 2021

(54) INTEGRATED HYDROTREATING AND DEEP HYDROGENATION OF HEAVY OILS INCLUDING DEMETALLIZED OIL AS FEED FOR OLEFIN PRODUCTION

(71) Applicant: Saudi Arabian Oil Company, Dhahran (SA)

(72) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/851,536

(22) Filed: Apr. 17, 2020

(51) Int. Cl.
*C10G 69/02* (2006.01)
*C10G 47/18* (2006.01)

(52) U.S. Cl.
CPC ..... *C10G 69/02* (2013.01); *C10G 47/18* (2013.01); *C10G 2300/107* (2013.01); *C10G 2300/1077* (2013.01); *C10G 2300/202* (2013.01); *C10G 2400/02* (2013.01); *C10G 2400/04* (2013.01); *C10G 2400/10* (2013.01)

(58) Field of Classification Search
USPC ..... 208/59, 308; 585/250, 400, 419, 420
See application file for complete search history.

(56) References Cited

U.S. PATENT DOCUMENTS 5,520,799 A * 5/1996 Brown ..... C10G 45/10 208/143
5,968,346 A 10/1999 Jung et al.
6,042,716 A 3/2000 Morel et al.
6,221,239 B1 4/2001 Morel et al.
6,451,198 B2 9/2002 Morel et al.
6,582,590 B1 6/2003 Riley et al.
6,824,673 B1 * 11/2004 Ellis ..... C10G 65/12 208/15
6,929,738 B1 * 8/2005 Riley ..... B01J 23/002 208/208 R
2013/0026065 A1 * 1/2013 Koseoglu ..... C10G 69/02 208/61
2013/0056394 A1 * 3/2013 Ancheyta Juarez ... C10G 65/14 208/80
2013/0068659 A1 * 3/2013 Koseoglu ..... C10G 65/02 208/80
2013/0186805 A1 * 7/2013 Koseoglu ..... C10G 45/52 208/89

(Continued)

FOREIGN PATENT DOCUMENTS

CN 102443431 A 5/2012
JP 8183964 A 7/1996

*Primary Examiner* — Nina Bhat
(74) *Attorney, Agent, or Firm* — Abelman, Frayne & Schwab

(57) ABSTRACT

An integrated process is provided herein having a first reaction zone to lower sulfur and nitrogen content of the initial feedstock to a target level to facilitate processing in a second reaction zone for deep hydrogenation. With the very low heteroatom content, noble metal catalyst materials used in the second reaction zone are protected and maximum saturation of aromatics is achieved. The processes and systems herein are suitable for converting certain heavy fractions, typically considered "low value" feedstocks, into higher value products including gasoline and diesel, and a hydrogen-rich, aromatic-lean heavy fraction suitable as feed for olefin production processes, or as a lubricant base oil.

28 Claims, 2 Drawing Sheets

(56) References Cited

U.S. PATENT DOCUMENTS

| | | | | |
|---|---|---|---|---|
| 2014/0054199 | A1* | 2/2014 | Koseoglu | C10G 47/22 208/88 |
| 2015/0014217 | A1* | 1/2015 | Smiley | C10G 45/16 208/59 |
| 2015/0152343 | A1* | 6/2015 | Vijay | C10G 69/08 208/60 |
| 2015/0184088 | A1* | 7/2015 | Dalal | C10G 45/02 208/212 |
| 2019/0194558 | A1* | 6/2019 | Eichelsdoerfer | C10G 69/02 |
| 2019/0194562 | A1* | 6/2019 | Eichelsdoerfer | B01J 35/1004 |
| 2020/0283688 | A1* | 9/2020 | Long | C10G 67/02 |

* cited by examiner

INTEGRATED HYDROTREATING AND DEEP HYDROGENATION OF HEAVY OILS INCLUDING DEMETALLIZED OIL AS FEED FOR OLEFIN PRODUCTION

RELATED APPLICATIONS

Not applicable.

BACKGROUND

Field of the Invention

The present invention relates to hydrogenation processes, and in particular an integrated hydrotreating and hydrogenation processes for deep hydrogenation of heavy oils including demetallized oil to produce effluents suitable as feed for olefin production.

Description of Related Art

Heavy hydrocarbon streams such as demetallized oil (DMO) are typically considered low value streams. These streams, and other heavy hydrocarbon streams such as vacuum gas oil, deasphalted oil (DAO), coker gas oil, cycle oil, and visbroken oil are commonly found in refineries and are generally less valued than middle distillate and naphtha streams. To obtain more desirable products from these types of heavy oils, significant additional processing is necessary.

For example, DMO or DAO can be are processed in refinery conversion units, such as one or more of hydrocracking, fluidized catalytic cracking (FCC), or coking, or alternatively are added to the fuel oil pool. The processing options are costly because of high severity operations, such as high pressure requirements and/or operation at short cycle and/or high catalyst to oil ratio to process these low value streams. Use in the fuel oil is limited due to stringent sulfur specifications.

Hydrotreating is one of the processing options. This process desulfurizes and denitrogenates the feedstock while increasing its hydrogen content slightly by hydrogenation at moderate pressure levels. The feedstock is partially hydrogenated, but in certain embodiments it is desirable to produce an essentially aromatic-free effluent for use as a downstream feedstock in conversion processes. Hydrocracking is more severe than hydrotreating, and accordingly costlier.

Hydrocracking processes are used commercially in many petroleum refineries. They are used to process a variety of feeds, for instance generally boiling in the range of about 370-565° C. in conventional hydrocracking units, and at about 565° C. and above in the residue hydrocracking units. In general, hydrocracking processes split the molecules of the feed into smaller, lighter, molecules having higher average volatility and economic value. Additionally, hydrocracking processes typically improve the quality of the hydrocarbon feedstock by increasing the hydrogen to carbon ratio and by removing organosulfur and organonitrogen compounds. The significant economic benefit derived from hydrocracking processes has resulted in substantial development of process improvements and more active catalysts. Three major hydrocracking process schemes include single-stage once through (mild) hydrocracking, series-flow hydrocracking with or without recycle, and two-stage recycle hydrocracking.

Mild hydrocracking or single-stage once through hydrocracking is the simplest of the hydrocracker configuration and typically occurs at operating conditions that are more severe than hydrotreating processes, and less severe than conventional full pressure hydrocracking processes. It uses one or more reactors for both treating steps and cracking reaction, so the catalyst must be capable of both hydrotreating and hydrocracking. This configuration is cost effective, but typically results in relatively low product yields (for example, a maximum conversion rate of about 60%). Single stage hydrocracking is often designed to maximize mid-distillate yield over a single or dual catalyst systems. Dual catalyst systems are used in a stacked-bed configuration or in two different reactors. The effluents are passed to a separation section including a fractionator column to separate the $H_2S$, $NH_3$, light gases ($C_1$-$C_4$), naphtha and middle distillate fractions. The hydrocarbons boiling above the range of the middle distillate fraction are typically unconverted bottoms that, in single stage systems, are passed to other refinery operations.

Series-flow hydrocracking with or without recycle is one of the most commonly used configurations. It uses one reactor (containing both treating and cracking catalysts) or two or more reactors for both treating and cracking reaction steps. In a series-flow configuration the entire hydrocracked product stream from the first reaction zone, including light gases (for example, $C_1$-$C_4$, $H_2S$, $NH_3$) and all remaining hydrocarbons, are sent to the second reaction zone. Unconverted bottoms from the fractionator column are recycled back into the first reactor for further cracking. This configuration converts heavy crude oil fractions such as vacuum gas oil (VGO), into light products and has the potential to maximize the yield of naphtha or middle distillates, depending on the recycle cut point used in the distillation section.

In two-stage recycle hydrocracking operations, the feedstock is refined by passing it over a hydrotreating catalyst bed in the first reaction zone. The effluents are passed to a separation zone to separate the light gases, naphtha and middle distillate fractions. The hydrocarbons boiling above the range of the middle distillate fraction are passed to the second reaction zone for additional cracking.

Conventionally most hydrocracking processes that are implemented for production of middle distillates and other valuable fractions retain aromatics such as those boiling in the middle distillate range (for instance about 180-370° C.). Aromatics boiling higher than the middle distillate range are also included and produced in the heavier fractions.

In all of the above-described hydrocracking process configurations, cracked products, along with partially cracked and unconverted hydrocarbons, are passed to a distillation column for separating into products including a naphtha range fraction, a jet fuel/kerosene range fraction, and a diesel range fraction. In addition, unconverted and partially converted products are separated, for example, boiling above the middle distillate fraction. Typical jet fuel/kerosene fractions (particularly those having a smoke point >25 mm) and diesel fractions (particularly those having a cetane number >52) are of high quality and well above the worldwide transportation fuel specifications. Although the hydrocracking unit products have relatively low aromaticity, aromatics that do remain lower the key indicative properties (smoke point and cetane number) for these products.

While these known processes are effective for certain feedstocks and product slates, problems arise when the feedstock is expanded to include DMO or DAO. DMO or DAO is derived from vacuum residue having a nominal boiling range at and above 565° C. The vacuum residue is treated by solvent deasphalting with paraffinic solvent, for example using paraffins with a carbon number in the range of 4-7. The recovered DMO or DAO is highly aromatic and contains a relatively high concentration of heteroatoms such as sulfur and nitrogen, particularly as compared to conventional hydrocracking feedstocks such as VGO. High aromatic and heteroatoms content of DMO or DAO fractions increase processing difficulty.

A need remains in the industry for improved and more cost effective processing options for converting heavy hydrocarbon feeds, including DMO and/or DAO, into hydrogen-rich effluents effective as olefin production unit feedstocks, or effective as base lube oil.

SUMMARY

An integrated process is provided herein having a first reaction zone to lower sulfur and nitrogen content of the initial feedstock to a target level to facilitate processing in a second reaction zone for deep hydrogenation. With the very low heteroatom content, noble metal catalyst materials used in the second reaction zone are protected and maximum saturation of aromatics is achieved. The processes and systems herein are suitable for converting certain heavy fractions, typically considered "low value" feedstocks, into higher value products including gasoline and diesel, and a hydrogen-rich, aromatic-lean heavy fraction suitable as feed for olefin production processes, or as a lubricant base oil. Typically, using high proportions of these "low value" feedstocks in conventional hydrocracking operations deteriorates the overall fuel pool quality.

In the processes and systems herein, a heavy oil feedstream is provided containing at least a portion thereof as demetallized oil and/or deasphalted oil. The heavy oil feedstream is reacted in the presence of hydrogen and a hydrotreating catalyst in a first reaction zone to produce a first effluent stream. The first reaction zone includes a hydrotreating operation, and comprises one or more reactors with hydrotreating catalyst that operate under conditions effective for desulfurization and denitrogenation of the feedstock, to produce the first reaction zone effluent stream characterized by a conversion of in the range of about 15-70 V %. The first reaction zone effluents stream is fractionating into at least a tops stream and a bottoms stream, wherein the tops stream comprises $C_1$-$C_4$ hydrocarbons, naphtha and middle distillates, and the bottoms stream comprises hydrocarbon components having an initial nominal boiling point in the range of about 320-400° C. The bottoms stream is hydrogenated in the presence of a deep hydrogenation catalyst in a second reaction zone to produce a second reaction zone effluent stream. The second reaction zone includes a hydrogenation operation, and comprises one or more reactors with deep hydrogenation catalyst that operate under conditions effective to produce the second reaction zone effluent stream having an aromatic saturation level of at least about 90 W % of the feedstock aromatics.

Still other aspects, embodiments, and advantages of these exemplary aspects and embodiments, are discussed in detail below. Moreover, it is to be understood that both the foregoing information and the following detailed description are merely illustrative examples of various aspects and embodiments, and are intended to provide an overview or framework for understanding the nature and character of the claimed aspects and embodiments. The accompanying drawings are included to provide illustration and a further understanding of the various aspects and embodiments, and are incorporated in and constitute a part of this specification. The drawings, together with the remainder of the specification, serve to explain principles and operations of the described and claimed aspects and embodiments.

BRIEF DESCRIPTION OF THE DRAWINGS

The invention will be described in further detail below and with reference to the attached drawings in which the same or similar elements are referred to by the same number, and where.

DETAILED DESCRIPTION

Figure 1:
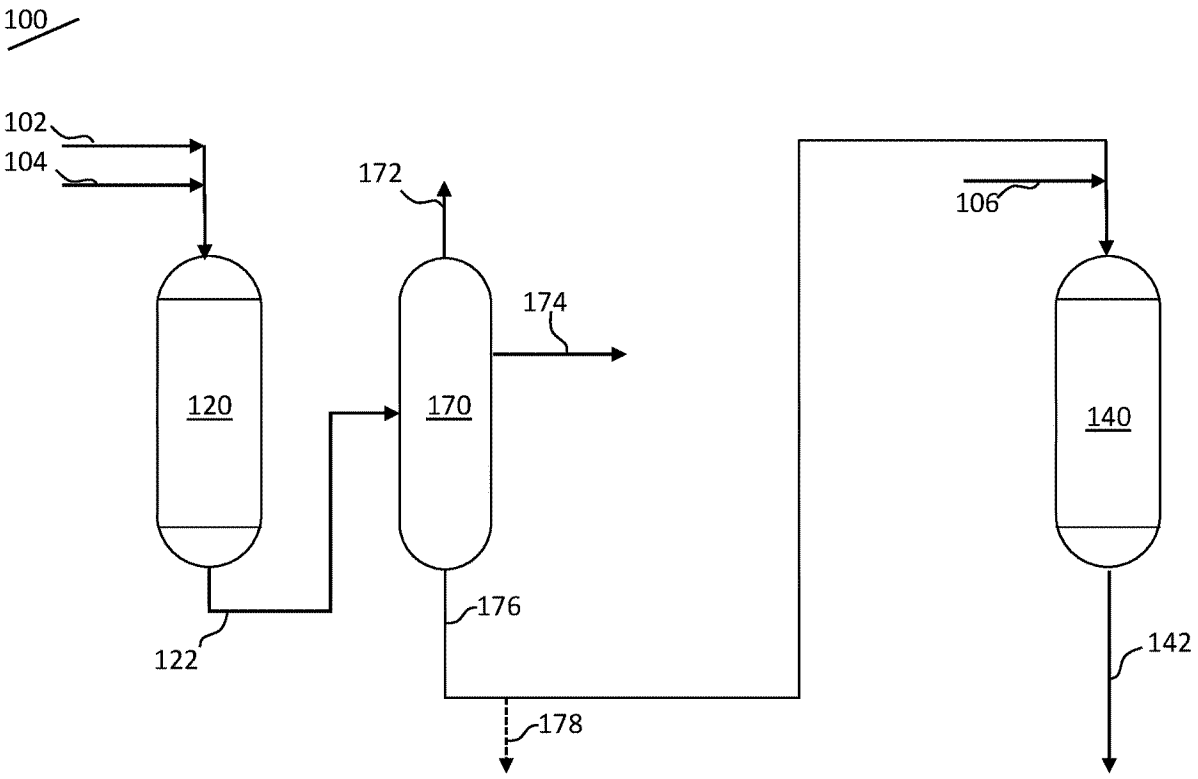
FIG. 1 is a process flow diagram of an embodiment of an integrated hydrotreating and deep hydrogenation process.

As used herein, volume percent or "V %" refers to a relative at conditions of 1 atmosphere pressure and 15° C.

The phrase "a major portion" with respect to a particular stream or plural streams, or content within a particular stream, means at least about 50 wt % and up to 100 wt %, or the same values of another specified unit.

The phrase "a significant portion" with respect to a particular stream or plural streams, or content within a particular stream, means at least about 75 wt % and up to 100 wt %, or the same values of another specified unit.

The phrase "a substantial portion" with respect to a particular stream or plural streams, or content within a particular stream, means at least about 90, 95, 98 or 99 wt % and up to 100 wt %, or the same values of another specified unit.

The phrase "a minor portion" with respect to a particular stream or plural streams, or content within a particular stream, means from about 1, 2, 4 or 10 wt %, up to about 20, 30, 40 or 50 wt %, or the same values of another specified unit.

The acronym "LPG" as used herein refers to the well-known acronym for the term "liquefied petroleum gas," and generally is a mixture of $C_3$-$C_4$ hydrocarbons. In certain embodiments, these are also referred to as "light ends."

The term "naphtha" as used herein refers to hydrocarbons boiling having an initial boiling point in the range of about 20-40° C. and an end boiling point in the range of about 170-205° C., for instance hydrocarbons boiling in the range of about 20-205, 20-193, 20-190, 20-180, 20-170, 32-205, 32-193, 32-190, 32-180, 32-170, 36-205, 36-193, 36-190, 36-180 or 36-170° C.

The term "middle distillate" as used herein relative to effluents from the atmospheric distillation unit or flash zone refers to hydrocarbons having an initial boiling point in the range of about 170-205° C. and an end boiling point in the range of about 320-400° C., for instance hydrocarbons boiling in the range of about 170-400, 170-370, 170-360, 170-350, 170-340, 170-320, 180-400, 180-370, 180-360, 180-350, 180-340, 180-320, 190-400, 190-370, 190-360, 190-350, 190-340, 190-320, 193-400, 193-370, 193-360, 193-350, 193-340, 193-320, 205-400, 205-370, 205-360, 205-350, 205-340 or 205-320° C. Middle distillate range fractions include components used for jet fuel, kerosene and diesel fuel.

The term "atmospheric residue" and its acronym "AR" as used herein refer to the bottom hydrocarbons obtained from atmospheric distillation and having an initial boiling point corresponding to the end point of the middle distillate range hydrocarbons, and having an end point based on the characteristics of the crude oil feed.

The term "vacuum gas oil" and its acronym "VGO" as used herein refer to hydrocarbons obtained from vacuum distillation and having an initial boiling point in the range of about 350-420° C. and an end boiling point in the range of about 510-565° C., for instance hydrocarbons boiling in the range of about 350-565, 350-540, 350-530, 350-510, 370-565, 370-550, 370-540, 370-530, 370-510, 400-565, 400-550, 400-540, 400-530, 400-510, 420-565, 420-550, 420-540, 420-530 or 420-510° C.

The term "vacuum residue" and its acronym "VR" as used herein refer to the bottom hydrocarbons obtained from vacuum distillation and having an initial boiling point corresponding to the end point of the VGO range hydrocarbons, and having an end point based on the characteristics of the crude oil feed.

The terms "pyrolysis oil" and its abbreviated form "py-oil" are used herein having their well-known meaning, that is, a heavy oil fraction, C10+, that is derived from steam cracking.

The terms "light pyrolysis oil" and its acronym "LPO" as used herein in certain embodiments refer to pyrolysis oil having an end boiling point of about 440, 450, 460 or 470° C.

The terms "heavy pyrolysis oil" and its acronym "HPO" as used herein in certain embodiments refer to pyrolysis oil having an initial boiling point of about 440, 450, 460 or 470° C.

The term "unconverted oil" and its acronym "UCO," also known as hydrocracker bottoms, hydrocracked bottoms, hydrocracker unconverted material and fractionator bottoms, is used herein having its known meaning, and refers to a highly paraffinic fraction obtained from a separation zone associated with a hydroprocessing reactor, and contains reduced nitrogen, sulfur and nickel content relative to the reactor feed, and includes in certain embodiments hydrocarbons having an initial boiling point in the range of about 340-370° C., for instance about 340, 360 or 370° C., and an end point in the range of about 510-560° C., for instance about 540, 550, 560° C. or higher depending on the characteristics of the feed to the hydroprocessing reactor, and hydroprocessing reactor design and conditions, for instance hydrocarbons boiling in the range of about 340-560, 340-550, 340-540, 360-560, 360-550, 360-540, 370-560, 370-550, or 370-540° C. UCO is also known in the industry by other synonyms including "hydrowax."

The term "coker gas oil" and its acronym "CGO" are used herein to refer to hydrocarbons boiling above an end point of the middle distillate range, for instance having an initial boiling point in the range of about 320-370° C., and an end boiling point in the range of about 510-565° C., which are derived from thermal cracking operations in a coker unit, for instance hydrocarbons boiling in the range of about 320-565, 320-540, 320-510, 340-565, 340-540, 340-510, 370-565, 370-540, or 370-510° C.

The term "heavy coker gas oil" and its acronym "HCGO" are used herein to refer to CGO in the heavy range, for instance having an initial boiling point from about 405-450° C., for instance hydrocarbons boiling in the range of about 405-565, 405-540, 405-510, 430-565, 430-540, 430-510, 450-565, 450-540, or 450-510° C.

The term "light coker gas oil" and its acronym "LCGO" are used herein to refer to CGO in the light range, for instance having an end boiling point from about 405-450° C., for instance hydrocarbons boiling in the range of about 320-450, 320-430, 320-405, 340-450, 340-430, 340-405, 370-450, 370-430, or 370-405° C.

The processes and systems herein are effective for initial heavy oil feedstocks conventionally considered low value streams within a refinery. The "heavy oil feedstock" as used herein is selected from the group consisting of heavy, light or full range straight run vacuum gas oil; demetallized oil; deasphalted oil; heavy, light or full range coker gas oil from coking operations including delayed coking; heavy, light or full range hydrotreated gas oil from hydrotreating operations; light or full range unconverted oil from hydrocracking or hydroprocessing operations; heavy, light or full range visbroken oil from visbreaking operations; heavy, light or full range cycle oil from FCC operations; synthetic crude oils; and straight run distillate or deasphalted fractions, of bitumens; shale oils; and coal oils. In certain embodiments the heavy oil feedstock generally has a boiling point range within about 350-800, 350-700, 350-600 or 350-565° C. In certain embodiments the heavy oil feedstock has an asphaltene content of less than or equal to about 500, 400, 300, 200 or 100 ppmw, in certain embodiments in the range of about 0-500, 0-400, 0-300, 0-300, 0-100, 10-500, 10-400, 10-300, 10-2, 10-100, 20-500, 20-500, 20-400, 20-300, 20-200 or 20-100 ppmw. In certain embodiments the heavy oil feedstock has a metals content (Ni+V) of less than or equal to about 50, 30, 10, 5 or 1 ppmw.

Referring to FIG. 1, an integrated system is provided herein to lower sulfur and nitrogen content of the initial feedstock 102 to a target heteroatom level (typically measured based on the content of sulfur and nitrogen compounds, "S+N") and achieve maximum aromatic saturation in the hydrogenated effluent 142. The target S+N level in the aromatic-lean hydrogenated effluent 142 is less than or equal to about 50, 30, or 10 ppmw. The level of aromatic saturation in the aromatic-lean hydrogenated effluent 142 is at least about 90, 95 or 98 W %. As defined herein the ppmw of the heteroatoms and W % of aromatic saturation are relative to the total mass of effluent 142.

The heavy oil feedstream 102 is desulfurized and denitrogenated in a hydrotreating zone 120 containing an effective quantity of desulfurization and denitrogenation catalysts. In certain embodiments, hydrotreating zone 120 is operated under conditions and/or containing catalysts to promote some degree of conversion, that is, production of hydrocarbons boiling at or below the atmospheric residue initial nominal boiling point, such as 370° C., including LPG, kerosene, naphtha, and atmospheric gas oil range components. The reactor effluents 122 are sent to a separation 170 zone to separate a bottoms fraction 176 from gases 172 and light and middle range liquid products 174. The bottoms 176 are passed to a hydrogenation zone 140 containing an effective quantity of catalyst for deep hydrogenation, such as heterogeneous catalyst materials containing noble metal as the active metal component on a suitable support and/or unsupported metal catalysts as described further herein.

The process herein is effective for increasing the value of a conventionally low value heavy oil feedstock stream 102 to generate high quality effluents, including kerosene and diesel from the liquid products 174, and a hydrogen-rich, aromatic-lean hydrogenated effluent 142 suitable as feedstock for olefin production processes by steam cracking or fluid catalytic cracking, or as a feedstock for lubricant base oil production. In certain embodiments the heavy oil feedstock is a blend of two or more types of heavy oils, for instance DMO or DAO and one or more additional heavy oils such as cycle oils or coker gas oil. In embodiments where the feedstock includes a blend including DMO or DAO and one or more additional heavy feedstocks, the feed can include a DMO or DAO content of at least about 1, 2, 3, 5, 7.5, 10, 15, 20, 30, 40, 50, 60, 70, 80, 90 or 95 V %. In certain embodiments the feedstock includes a blend including a DMO or DAO content of at least about 1, 2, 3, 5, 7.5, 10, 15, 20 or 25 V %.

In certain embodiments, DMO used as all or a portion of the heavy oil feedstock 102 is derived from a suitable solvent extraction operation such as a DEMEX™ process (a demetallization process commercially available from Honeywell UOP, US). In additional embodiments, the DMO feed is contacted with demetallization catalyst to achieve a target metal content level (typically measured based on the content of nitrogen and vanadium compounds, "Ni+V"). For instance, in certain embodiments a target Ni+V content of the feedstock 102 is less than or equal to about 50, 30, 10, 5, or 1 ppmw.

In embodiments in which the initial feed contains excessive metal content, all or a portion of said feed can be contacted with an effective quantity of demetallization catalyst to maximize the operational time of the hydrotreating catalyst in hydrotreating zone 120. Contact with demetallization catalyst can occur within a bed of a hydrotreating reactor within zone 120 and/or within a separate demetallization reactor upstream of a hydrotreating reactor within zone 120. In certain embodiments, parallel demetallization reactors are integrated and operated in swing mode, so that when the demetallization in one reactor becomes spent, the contact with demetallization catalysts continues in the other reactor. This permits catalyst in the first reactor to be changed and/or regenerated. In additional embodiments, a demetallization reactor can be operated with a catalyst replacement system, such as a moving bed reactor or ebullated bed reactor. Suitable demetallization catalysts are mesoporous and/or macroporous material as are known to those skilled in the art. Metal content from the feed is deposited after the hydrodemetallization reaction on the catalyst, in certain catalysts materials up to 100 W % of metals on the basis of fresh catalyst mass.

Hydrotreating zone 120 contains an effective quantity of catalyst having hydrotreating functionality and operates under conditions effective for hydrotreating, and in certain embodiments under conditions effective for some degree of conversion. Hydrotreating zone 120 generally includes one or more inlets in fluid communication with a source of initial feedstock 102 and a source of hydrogen gas 104. One or more outlets of hydrotreating zone 120 discharge an effluent stream 122 which is in fluid communication with one or more inlets of the fractionating zone 170, typically having one or more high pressure and optionally low pressure separation stages there between for recovery of recycle hydrogen (not shown).

Fractionating zone 170 includes one or more outlets for discharging gases 172 including $H_2S$, $NH_3$, and light hydrocarbons ($C_1$-$C_4$); one or more outlets for recovering product 174 including naphtha and middle distillate range fractions; and one or more outlets for discharging bottoms 176 including hydrocarbons having an initial nominal boiling point at or above the endpoint of the middle distillate range fraction.

One or more bottom outlets of the fractionating zone 170 are in fluid communication with the one or more inlets of the hydrogenation zone 140 for deep hydrogenation. Hydrogenation zone 140 contains an effective quantity of catalyst having deep hydrogenation functionality and operates under conditions effective for hydrogenation, and generally includes one or more inlets in fluid communication with one or more outlets of the fractionating zone 170 and a source of hydrogen gas 106. An outlet of the hydrogenation zone 140 discharges a hydrogenated effluent stream 142. As described herein, deep hydrogenation includes hydrogenation of aromatics by at least about 90, 95 or 98 W %.

In operation of the system 100, a feedstock stream 102 and a hydrogen stream 104 are charged to the hydrotreating zone 120. Hydrogen stream 104 provides an effective quantity of hydrogen to support the requisite degree of hydrotreating zone 120, feed type, reactor type, reaction conditions, catalyst selection and quantity, and other factors. Hydrogen stream 104 can be any combination including make-up hydrogen, recycle hydrogen from high and low pressure separation subsystems (not shown) between hydrotreating zone 120 and fractionating zone 170, recycle hydrogen from high and low pressure separation subsystems (not shown) downstream of the hydrogenation zone 140, and/or derived from fractionator gas stream 172. Hydrotreating zone 120 operates under effective conditions for production of a hydrotreated reaction effluent stream 122 which is passed to the fractionating zone 170. One or more high pressure and low pressure separation stages can be integrated as is known to recover recycle hydrogen are included between the hydrotreating zone 106 and fractionating zone 170. For example, effluents from the hydrotreating reaction vessel are cooled in an exchanger and sent to a high pressure cold or hot separator. Separator tops are cleaned in an amine unit and the resulting hydrogen rich gas stream is passed to a recycling compressor to be used as a recycle gas in the hydrocracking reaction vessel. Separator bottoms from the high pressure separator, which are in a substantially liquid phase, are cooled and then introduced to a low pressure cold separator. Remaining gases including hydrogen, $H_2S$, $NH_3$ and any light hydrocarbons, which can include $C_1$-$C_4$ hydrocarbons, can be conventionally purged from the low pressure cold separator and sent for further processing, such as flare processing or fuel gas processing. The liquid stream from the low pressure cold separator is passed to the fractionating zone 170.

In certain embodiments, flexible operation of the hydrotreating zone 120 is practiced, in which an operator can control the level of conversion (V %) in stream 122 in the range of about 15-70, 20-70, 30-70, 15-60, 20-60 or 30-60. For instance, if there is an increased demand for distillates, hydrotreating zone 120 can operate with conversion in the range of about 30-70, 30-60, 50-70 or 50-60; if there is an increased demand for feedstocks for olefin production processes by steam cracking or fluid catalytic cracking, or feedstocks for lubricant base oil production, conversion can be limited to the range of about 15-35, 15-30, 20-35, or 20-30. The lower limit of conversion is typically dependent upon the limiting denitrogenation reactions to reduce nitrogen levels to reduce the combined sulfur and nitrogen levels to the target level. Conversion can be controlled, for example, based on the selected catalyst, reactor type, and operating conditions including pressure, temperature, liquid hourly space velocity and hydrogen to oil ratio.

The reaction effluent stream 122 is passed to fractionation zone 170, generally to recover gas and liquid products and byproducts, and separate a bottoms fraction. Gas stream 172, typically containing $H_2$, $H_2S$, $NH_3$, and light hydrocarbons ($C_1$-$C_4$), is discharged and recovered and can be further processed as is known in the art, including for recovery of recycle hydrogen. One or more streams 174 are discharged appropriate outlets of the fractionator and can be further processed and/or blended in downstream refinery operations to produce gasoline, kerosene and/or diesel fuel, or other petrochemical products. In certain embodiments (not shown), zone 170 can operate as a flash vessel to separate heavy components at a suitable cut point in the range of about 350-400° C., for instance, at 350, 370 or 400° C. In further embodiments (not shown), zone 170 can be a stripping column, wherein the stripping fluid is steam or a suitable fluid such as nitrogen, hydrogen, $C_1$-$C_4$ or naphtha.

All or a portion of the fractionator bottoms stream 176 is passed to the hydrogenation zone 140. In certain embodiments a portion of the fractionator bottoms from the hydrocracking reaction effluent is removed as bleed stream 178. In certain embodiments, a bleed stream 178, for instance up to about 50, 40, 30, 20, 10 or 5 V %, or in certain embodiments in the range of about 1 to about 5 V %, is drawn from bottoms 176 upstream of the hydrogenation zone 140. All or any portion of bleed stream 178 can be used, for instance, as fuel oil.

Hydrogenation zone 140 operates under conditions effective for production of the hydrogenated effluent stream 142. The hydrogenated reaction effluent stream 142 is recovered, optionally through one or more high pressure separators and/or low pressure separators to recover recycle hydrogen and remove certain light gases.

In certain embodiments, the hydrogenated reaction effluent 142 is advantageously effective as a feedstock for olefin production, in which C—C bonds are cracked. The hydrogenated reaction effluent stream 142 is aromatic lean and rich in saturates such as paraffins and naphthenes. This is particularly desirable as a hydrogen-rich feedstream for olefin production by steam cracking or fluid catalytic cracking. In those processes, cracking occurs by C—C cleavage in the paraffinic and naphthenic structures; stable aromatic bonds are significantly more resistant to cleavage during steam cracking or fluid catalytic cracking processes, particularly those tailored to olefin production. For instance, the process herein produces an oil fraction that is highly naphthenic and paraffinic, with little or no sulfur content and having a viscosity index in the range of about 80-120.

Hydrotreating zone 120 can contain one or more fixed-bed, ebullated-bed, slurry-bed, or moving bed reactors. In certain embodiments, hydrotreating zone 120 includes one or more reactors in series, or a reactor with multiple beds, having different catalysts systems to target certain heteroatoms. In further embodiments multiple reactors can be provided in parallel to facilitate catalyst replacement and/or regeneration.

Reactors in the hydrotreating zone 120 are generally operated under conditions effective for hydrodesulfurization and hydrodenitrogenation of the feedstock, and can vary depending on the particular type of reactor, the feed characteristics, the desired product slate and the catalyst selection. In certain embodiments the zone 120 is operated under conditions and using catalysts effective for cracking. Under suitable operating conditions and using effective catalysts described above in the hydrotreating zone 120, about 90-99.99 W % of sulfur and nitrogen compounds can be removed from the feed, and hydrogen sulfide and ammonia are removed. In addition, in certain embodiments hydrotreating zone is operated under flexible conditions to control the level of conversion (V %) of stream 122 into product gas and distillate fractions, in the range of about 15-70, 20-70, 30-70, 15-60, 20-60 or 30-60, via outlets 172, 174.

Suitable reaction conditions in the hydrotreating zone 120 include a reaction temperature (° C.) in the range of from about 300-500, 300-475, 300-450, 300-385, 330-500, 330-475, 330-450, 330-385, 350-500, 350-475, 350-450 or 350-385; a hydrogen partial pressure (bars) in the range of from about 60-300, 60-200, 60-150, 60-120, 70-300, 70-200, 70-150, 70-120, 80-300, 80-200, 80-150, 80-120, 100-300, 100-200, 100-150 or 100-120; a hydrogen feed rate (standard liters of hydrogen per liter of hydrocarbon feed, StL/L) up to about 2500, 2000 or 1500, in certain embodiments from about 500-2500, 500-2000, 500-1500, 1000-2500, 1000-2000 or 1000-1500; and a feed rate (liquid hourly space velocity, $h^{-1}$) in the range of from about 0.1-10.0, 0.1-5.0, 0.1-2.0, 0.3-10.0, 0.3-5.0, 0.3-2.0, 0.5-10.0, 0.5-5.0 or 0.5-2.0.

In certain embodiments, effective catalysts used in hydrotreating zone 120 possess hydrotreating functionality, including hydrodesulfurization, hydrodenitrogenation and/or hydrodemetallization, to remove sulfur, nitrogen and other contaminants, with a limited degree of conversion into lighter fractions (for instance in the range of 10-30 V %). Suitable catalysts include those known in the fields of VGO and DMO hydrotreating, and typically contain one or more active metal components of metals or metal compounds (oxides or sulfides) selected from the Periodic Table of the Elements IUPAC Groups 6, 7, 8, 9 and 10. The catalysts can be supported or unsupported metal catalysts.

Unsupported catalysts in the hydrotreating zone 120 can be metallic or multi-metallic materials formed of metals or metal compounds selected from the Periodic Table of the Elements IUPAC Groups 6, 7, 8, 9 and 10, for example transition metals such as Ni, Co, Mo and W in a sulfided form. In certain embodiments, unsupported catalysts do not contain alumina or aluminum. For instance, unsupported metal catalysts can be metal oxides that are converted to sulfided form by contacting with a sulfiding medium such as hydrogen sulfide as is conventionally known.

Supported catalysts in the hydrotreating zone 120 can include one or more active metal component(s) that are typically deposited or otherwise incorporated on a support, which can be amorphous and/or structured, such as alumina, silica-alumina, silica, titania, titania-silica or titania-silicates. Combinations of active metal components can be composed of different particles/granules containing a single active metal species, or particles containing multiple active species. For example, effective hydrotreating catalysts include one or more of an active metal component selected from the group consisting of cobalt, nickel, tungsten, molybdenum (oxides or sulfides), incorporated on an alumina support, typically with other additives. In certain embodiments in which an objective is hydrodenitrogenation and treatment of difficult feedstocks such as demetallized oil, the supports are acidic alumina, silica alumina or a combination thereof. In embodiments in which the objective is hydrodenitrogenation and increased hydrocarbon conversion, the supports are silica alumina, or a combination thereof. Silica alumina is useful for difficult feedstocks for stability and enhanced cracking. In certain embodiments, the catalyst particles have a pore volume in the range of about (cc/gm) 0.15-1.70, 0.15-1.50, 0.30-1.50 or 0.30-1.70; a specific surface area in the range of about (m2/g) 100-400, 100-350, 100-300, 150-400, 150-350, 150-300, 200-400, 200-350 or 200-300; and an average pore diameter of at least about 10, 50, 100, 200, 500 or 1000 angstrom units. The active metal component(s) are incorporated in an effective concentration, for instance, in the range of (wt % based on the mass of the oxides, sulfides or metals relative to the total mass of the catalysts) 1-40, 1-30, 1-10, 1-5, 2-40, 2-30, 2-10, 3-40, 3-30 or 3-10. In certain embodiments, the active metal component(s) include one or more of cobalt, nickel, tungsten and molybdenum, and effective concentrations are based on all the mass of active metal components on an oxide basis. In certain embodiments, hydrotreating catalysts are configured in one or more beds selected from nickel/tungsten/molybdenum, cobalt/molybdenum, nickel/molybdenum, nickel/tungsten, and cobalt/nickel/molybdenum. Combinations of one or more beds of nickel/tungsten/molybdenum, cobalt/molybdenum, nickel/molybdenum, nickel/tungsten and cobalt/nickel/molybdenum, are useful for difficult feedstocks such as demetallized oil, and to increase hydrocracking functionality.

In other embodiments, effective catalysts used in hydrotreating zone 120 possess hydrotreating (hydrodesulfurization, hydrodenitrogenation and/or hydrodemetallization) functionality to remove sulfur, nitrogen and other contaminants, and hydrocracking functionality to convert refined and partially cracked feedstocks into lighter fractions. Suitable catalysts include those known in the fields of VGO and DMO hydrotreating and hydrocracking, and typically contain one or more active metal components of metals or metal compounds (oxides or sulfides) selected from the Periodic Table of the Elements IUPAC Groups 6, 7, 8, 9 and 10. One or more active metal component(s) are typically deposited or otherwise incorporated on a support, which can be amorphous and/or structured, such as alumina, silica-alumina, silica, titania, titania-silica, titania-silicates, or zeolites. Combinations of active metal components can be composed of different particles/granules containing a single active metal species, or particles containing multiple active species. For example, effective hydrotreating/hydrocracking catalysts include one or more of an active metal component selected from the group consisting of cobalt, nickel, tungsten, molybdenum (oxides or sulfides), incorporated on acidic alumina, silica alumina, zeolite or a combination thereof. In embodiments in which zeolites are used, they are conventionally formed with one or more binder components such as alumina, silica, silica-alumina and mixtures thereof. In certain embodiments in which an objective is hydrodenitrogenation and treatment of difficult feedstocks such as demetallized oil, the supports are acidic alumina, silica alumina or a combination thereof. In embodiments in which the objective is hydrodenitrogenation and increased hydrocarbon conversion, the supports are silica alumina, or a combination thereof. Silica alumina is useful for difficult feedstocks for stability and enhanced cracking. In certain embodiments, the catalyst particles have a pore volume in the range of about (cc/gm) 0.15-1.70, 0.15-1.50, 0.30-1.50 or 0.30-1.70; a specific surface area in the range of about (m2/g) 100-900, 100-500, 100-450, 180-900, 180-500, 180-450, 200-900, 200-500 or 200-450; and an average pore diameter of at least about 45, 50, 100, 200, 500 or 1000 angstrom units. The active metal component(s) are incorporated in an effective concentration, for instance, in the range of (wt % based on the mass of the oxides, sulfides or metals relative to the total mass of the catalysts) 1-40, 1-30, 1-10, 1-5, 2-40, 2-30, 2-10, 3-40, 3-30 or 3-10. In certain embodiments, the active metal component(s) include one or more of cobalt, nickel, tungsten and molybdenum, and effective concentrations are based on all the mass of active metal components on an oxide basis. In certain embodiments, one or more beds are provided in series in a single reactor or in a series of reactors. For instance, a first catalyst bed containing active metals on silica alumina support is provided for hydrodenitrogenation, hydrodesulfurization and hydrocracking functionalities, followed by a catalyst bed containing active metals on zeolite support for hydrocracking functionality.

It is appreciated that the reactor type, operating conditions and/or catalyst selection associated with the hydrotreating zone 120 can vary based on the desired conversion, and based on the feed composition. For instance, in certain embodiments for feed compositions containing up to about 30 V % DMO, an effective configuration of the hydrotreating zone 120 includes one or more fixed bed reaction vessels operating in the range of about 80-100 bars. For feed compositions containing 0 to about 1 V % DMO, the reaction vessels can be loaded with catalyst effective for VGO hydrotreating and/or hydrocracking, such as Ni—Mo on alumina supports. For feed compositions containing about 1-30 V % DMO, the reaction vessels can be loaded with catalyst effective for DMO hydrotreating and/or hydrocracking, such as Ni—Mo on silica-alumina supports. Other conditions can also vary based on the feed. For instance, at 0% DMO levels, effective conditions include a reaction temperature in the range of about 360-420° C., a liquid hourly space velocity in the range of about 0.75-1.5 $h^{-1}$, and a hydrogen to oil ratio in the range of about 800-1200 StL/L, to yield effective conversion levels, for instance up to about 50 V % in mild conversion and up to about 95 or 99 V % for full conversion. It has been observed that for a 0.5 V % of DMO increase in the feedstock, conversion is reduced by about 1 V % at constant temperatures, which translates to 0.4° C. temperature increase change to maintain conversion constant. In operation, when the DMO percentage is increased, an operator may adjust only one parameter to maintain the conversion level. For example, at about 1% DMO levels, VGO hydrotreating catalysts can be used, and effective conditions include a reaction temperature in the range of about 361-421° C., a liquid hourly space velocity in the range of about 0.73-1.45 $h^{-1}$, and a hydrogen to oil ratio in the range of about 800-1200 StL/L, to yield conversion levels of up to about 94.5, 99.9 or 100 V %, for instance between about 50-94.5, 50-99.9 or 50-100 V %. At about 5% DMO levels, DMO hydrotreating catalysts can be used, and effective conditions include a reaction temperature in the range of about 365-425° C., a liquid hourly space velocity in the range of about 0.67-1.34 $h^{-1}$, and a hydrogen to oil ratio in the range of about 800-1200 StL/L, to yield conversion levels of up to about 92.5 V %, for instance between about 48-92.5 V %. At about 15% DMO levels, DMO hydrotreating catalysts can be used, and effective conditions include a reaction temperature in the range of about 371-431° C., a liquid hourly space velocity in the range of about 0.60-1.20 $h^{-1}$, and a hydrogen to oil ratio in the range of about 800-1200 StL/L, to yield conversion levels of up to about 87.5 V %, for instance between about 45-87.5 V %. At about 30% DMO levels, DMO hydrotreating catalysts can be used, and effective conditions include a reaction temperature in the range of about 382-442° C., a liquid hourly space velocity in the range of about 0.58-1.16 $h^{-1}$, and a hydrogen to oil ratio in the range of about 1000-1500 StL/L, to yield conversion levels of up to about 80 or 85 V % for instance between about 40-80 or 40-85 V %. At lower conversion rates, catalyst cycle length is increased.

In other embodiments for feed compositions containing greater than or equal to about 30 V % DMO, an effective configuration of the hydrotreating zone 120 includes one or more fixed bed reaction vessels operating in the range of about 120-200 bars, and reaction vessel(s) can be loaded with catalyst effective for DMO hydrotreating and/or hydrocracking, such as Ni—Mo on silica-alumina supports or Ni—Mo on silica-alumina-zeolite supports. For example, in a higher pressure operation and at about 30% DMO levels, DMO hydrotreating catalysts can be used, and effective conditions include a reaction pressure in the range of about 120-150 bars, reaction temperature in the range of about 390-442° C., a liquid hourly space velocity in the range of about 0.58-1.16 and a hydrogen to oil ratio in the range of about 1000-1500 StL/L. At about 50% DMO levels, DMO hydrotreating catalysts can be used, and effective conditions include a reaction pressure in the range of about 150-170 bars, reaction temperature in the range of about 405-455° C., a liquid hourly space velocity in the range of about 0.23-0.47 $h^{-1}$, and a hydrogen to oil ratio in the range of about 1200-2000 StL/L. At about 95-100% DMO levels, DMO hydrotreating catalysts can be used, and effective conditions include a reaction pressure in the range of about 150-200 bars, reaction temperature in the range of about 410-455° C., a liquid hourly space velocity in the range of about 0.15-0.30 $h^{-1}$, and a hydrogen to oil ratio in the range of about 1500-2500 StL/L.

The hydrogenation zone 140 can contain one or more fixed-bed, ebullated-bed, slurry-bed, moving bed, continuous stirred tank (CSTR) or tubular reactors, in series and/or parallel arrangement. In certain embodiments, multiple reactors can be provided in parallel in the hydrogenation zone 140 to facilitate catalyst replacement and/or regeneration. The reactor(s) are operated under conditions effective for deep hydrogenation of the bottoms stream 176, and such conditions can vary based on, for instance, the particular type of reactor, the feed characteristics, the desired product slate and the catalyst selection. Additional equipment, including exchangers, furnaces, feed pumps, quench pumps, and compressors to feed the reactor(s) and maintain proper operating conditions, are well known and are considered part of the hydrogenation zone 140. In addition, equipment including pumps, compressors, high temperature separation vessels, low temperature separation vessels and the like to separate reaction products and provide hydrogen recycle within the hydrogenation zone 140, are well known and are considered part of the hydrogenation zone 140.

In certain embodiments, the hydrogenation zone 140 operating conditions that are effective for deep hydrogenation of the bottoms stream 176 include:

a reaction temperature (° C.) in the range of from about 250-450, 250-400, 250-350, 250-320, 250-310, 280-450, 280-400, 280-350, 280-320, 280-310, 300-450, 300-400, 300-350, or 300-320;

a hydrogen partial pressure (bars) in the range of from about 20-200, 20-150, 20-125, 20-100, 20-85, 20-70, 30-200, 30-150, 30-125, 30-100, 30-85, 30-70, 40-200, 40-150, 40-125, 40-100, 40-85, 40-70, 50-200, 50-150, 50-125, 50-100, 50-85, 50-70, 80-200, 80-150, 80-125 or 80-100;

a hydrogen to oil feed ratio (StL/L) up to about 3000, 2500, 2000 or 1500, in certain embodiments from about 500-3000, 500-2500, 500-2000, 500-1500, 1000-2500, 1000-2000 or 1000-1500; and a feed rate (liquid hourly space velocity $h^{-1}$) in the range of from about 0.1-5.0, 0.1-3.0, 0.1-2.0, 0.5-5.0, 0.5-3.0, 0.5-2.0, 1.0-5.0, 1.0-5.0 or 1.0-2.0.

An effective quantity of hydrogenation catalyst used in the hydrogenation zone 140 that is effective for deep hydrogenation. Suitable hydrogenation catalysts contain one or more active metal component of metals or metal compounds (oxides or sulfides) selected from the Periodic Table of the Elements IUPAC Groups 7, 8, 9 and 10. In certain embodiments the active metal component is one or more of Pt, Pd, Ti, Rh, Re, Ir, Ru, and Ni, or a combination thereof. In certain embodiments the active metal component comprises a noble metal selected from the group consisting of Pt, Pd, Rh, Re, Ir, and Ru, or a combination thereof. The combinations can be composed of different particles/granules containing a single active metal species, or particles containing multiple active species. Such noble metals can be provided in the range of (wt % based on the mass of the metal relative to the total mass of the catalyst) 0.01-5, 0.01-2, 0.05-5, 0.05-2, 0.1-5, 0.1-2, 0.5-5, or 0.5-2. In certain embodiments, the catalyst particles have a pore volume in the range of about (cc/gm) 0.15-1.70, 0.15-1.50, 0.30-1.50 or 0.30-1.70; a specific surface area in the range of about ($m^2$/g) 100-400, 100-350, 100-300, 150-400, 150-350, 150-300, 200-400, 200-350 or 200-300; and an average pore diameter of at least about 10, 50, 100, 200, 500 or 1000 angstrom units.

The active metal component typically deposited or otherwise incorporated on a support, for example, amorphous alumina, and in certain embodiments non-acidic amorphous alumina and in certain embodiments non-acidic amorphous alumina containing about 0.1-30, 0.1-20, 0.1-15, 0.1-10, 0.1-5, 0.5-30, 0.5-20, 0.5-15, 0.5-10, 0.5-5, 1-30, 1-20, 1-15, 1-10, 1-5, 2.5-30, 2.5-20, 2.5-15, 2.5-10 or 2.5-5 W %, of zeolite, including USY zeolite. Non-acidic catalysts are selected for the hydrogenation catalyst so as to favor hydrogenation reactions. Particularly effective hydrogenation catalyst to promote hydrogenation reactions include noble metal active catalyst components on non-acidic supports, such as Pt, Pd or combinations thereof on non-acidic supports such as alumina. In certain embodiments a suitable hydrogenation catalyst includes a non-acidic, with relatively small amounts of zeolite such as USY zeolite, for instance 0.1-5 wt %, having Pt, Pd or combination thereof as the active metal component.

In certain embodiments, the catalyst and/or the catalyst support is prepared in accordance with U.S. Pat. No. 9,221,036 and its continuation U.S. Pat. No. 10,081,009 (jointly owned by the owner of the present application, and subject to a joint research agreement), which is incorporated herein by reference in their entireties. Such a hydrogenation catalyst includes a modified USY zeolite support having one or more of Ti, Zr and/or Hf substituting the aluminum atoms constituting the zeolite framework thereof. For instance, the catalyst effective for deep hydrogenation include an active metal component carried on a support containing an ultra-stable Y-type zeolite, wherein the above ultra-stable Y-type zeolite is a framework-substituted zeolite (referred to as a framework-substituted zeolite) in which a part of aluminum atoms constituting a zeolite framework thereof is substituted with 0.1-5 mass % zirconium atoms and 0.1-5 mass % titanium ions calculated on an oxide basis.

Depending upon the need for distillate fuels, the hydrogenation catalyst in the hydrogenation zone 140 includes a cracking component, including for instance a zeolite support formulated for hydrocracking operations, such as an FAU zeolite framework, containing zeolite synthesized using conventional methods and post modified for hydrocracking. One example is a Ti—Zr-USY zeolite. The USY zeolite, which is a FAU zeolite framework, is further modified by acid treatment to have meso-porosity and insertion of transition metals such as Ti and Zr. The zeolite content can be adjusted based on the desired distillate production, whereby increased zeolite content increased distillate yields at optimum conversion level.

Catalyst using noble metal active catalyst components are effective at relatively lower temperatures. As will be appreciated by those having ordinary skill in the art, aromatic hydrogenation reactions are more favorable at lower temperatures, whereas high temperatures are required for cracking. The delta temperature for cracking as compared to hydrogenation can be in the range of about 30-80° C.

Figure 2:
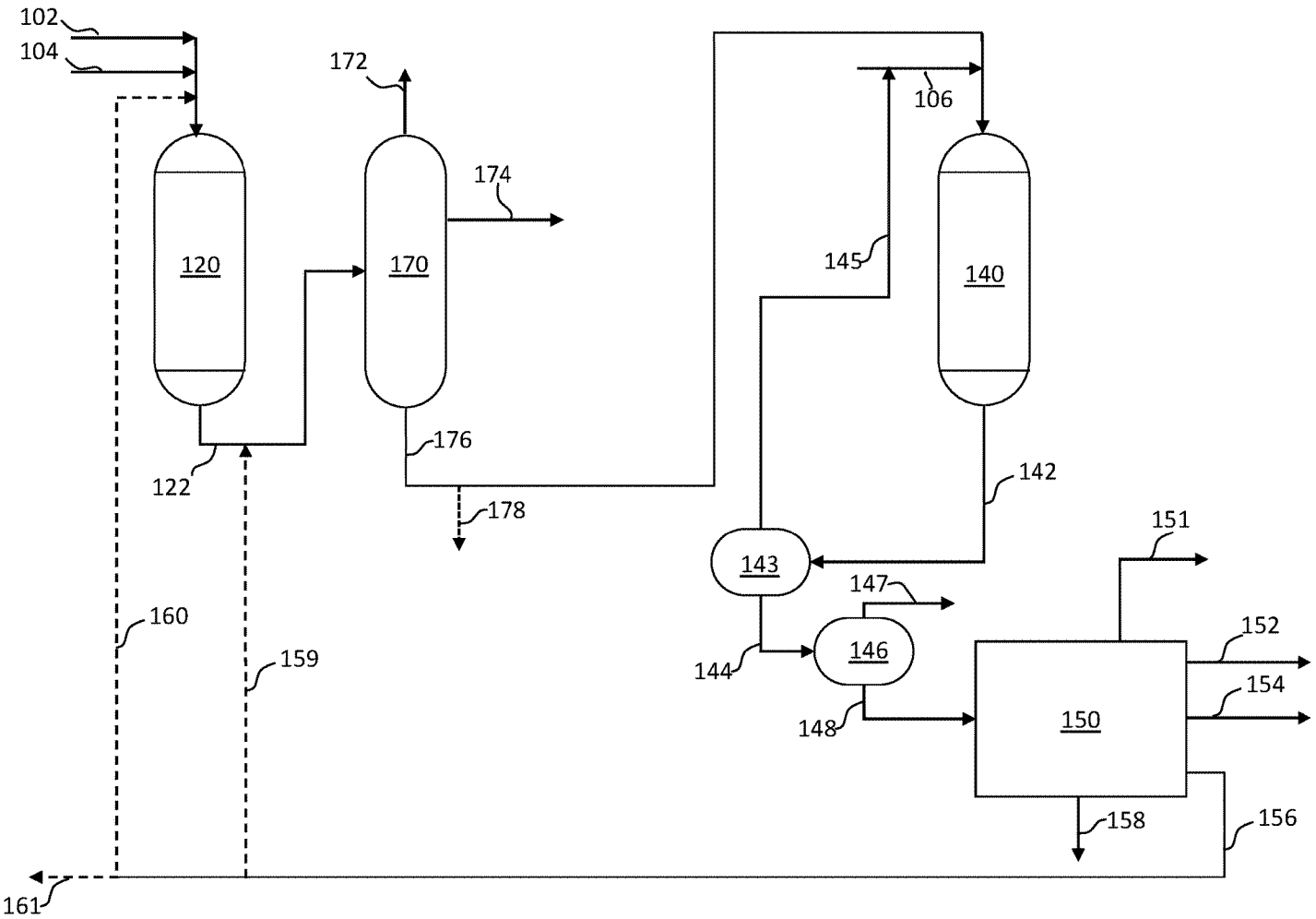
FIG. 2 is process flow diagram similar to that of FIG. 1 showing integration with a light olefin production zone.

Referring to FIG. 2, another embodiment is provided in which the hydroprocessing zone(s) are integrated with a light olefin production zone, such as an FCC zone, a high severity FCC zone (HSFCC), or a thermal cracking zone. All or a portion of the liquid products 148 derived from the hydrogenated effluent 142 are processed and separated in a light olefin production zone 150. Bottoms 156 from the light olefin production zone 150, such as cycle oil from an FCC or HSFCC zone (full range, light or heavy cycle oil), or pyrolysis oil from a thermal cracking zone (full range, light or heavy pyrolysis oil), are recycled to the hydrogenation zone 140 (shown by line 159, for instance up to about 50, 40, 30, 20, 15, 10 or 5 V %, or in certain embodiments in the range of about 5-20 V %). In certain embodiments, all or a portion of bottoms 156 are recycled to the hydrotreating zone 120 (shown by line 160), to or to both hydrotreating zone 120 and hydrogenation zone 120. In certain embodiments a portion of bottoms 156 is purged from the system (shown by line 161, for instance up to about 5 V %, or in certain embodiments in the range of about 1-5 V %). According to the present process, in certain embodiments substantially all, for instance at least about 90, 95 or 99 V %, of the bottoms 156 are recycled so that the operation approaches a recycle to extinction process.

Light olefin production zone 150 is schematically shown in FIG. 2 having an inlet for receiving the liquid products 148, and plural effluent outlets. The reactor(s) within the light olefin production zone 150, which can be a riser reactor as typically used in conventional FCC units, a downer reactor as typically used in HSFCC units, or a steam pyrolysis reactor, are not shown, nor are the separation subsystems, all of which are known to those having ordinary skill in the art. The effluents are schematically shown as including a light stream 151 including hydrogen, methane, LPG and dry gases, a light olefin product stream 152 including ethylene, propylene, and butenes, a light liquid product stream 154 including gasoline, and a heavy liquid recycle stream 156, including light cycle oil from an FCC or HSFCC zone generally boiling in a range of from about 200-400° C., heavy cycle oil from an FCC or HSFCC zone generally boiling in a range of from about 300-500° C., or pyrolysis oil from a thermal cracking zone. Individual products ethylene, propylene, and butenes are separated according to processes known in the art. In addition, in certain embodiments, for instance when the light olefin production zone 150 includes a steam pyrolysis reactor, coke 158 is a by-product formed that is removed by hydraulic or mechanical operations according to processes known in the art.

For the purpose of this simplified schematic illustration and description, the numerous valves, temperature sensors, electronic controllers and the like that are customarily employed and well known to those of ordinary skill in the art of fluid catalyst cracking are not included. Accompanying components that are in conventional hydroprocessing units such as, for example, hydrogen recycle sub-systems, bleed streams, spent catalyst discharge sub-systems, and catalyst replacement sub-systems the like are not shown. In addition, accompanying components that are in conventional thermal cracking systems such as steam supplies, coke removal sub-systems, pyrolysis sections, convection sections and the like are not shown. Further, accompanying components that are in conventional FCC systems such as, for example, air supplies, catalyst hoppers, flue gas handling the like are not shown.

In some embodiments, individual unit operations can include a controller to monitor and adjust the product slate as desired. A controller can direct parameters within any of the individual unit operations of the system depending upon the desired operating conditions, which may, for example, be based on customer demand and/or market value. A controller can adjust or regulate valves, feeders or pumps associated with one or more unit operations based upon one or more signals generated by operator data input and/or automatically retrieved data.

In one embodiment, a controller can be in electronic communication with, and adjust, valves, feeders and/or pumps associated with the effluent from separation zone 170 to direct a portion of light and middle range liquid products 174, or a fraction thereof, to the light olefin production zone 150, rather than passing them on to respective fuel product pools, if the desired product slate includes an increase in olefin production.

In another embodiment, a controller can be in electronic communication with, and adjust, adjust thermostats, pressure regulators, valves, feeders and/or pumps associated with the hydrotreating zone 120 to adjust the residence time, hydrogen feed rate, operating temperature, operating pressure, or other variables to modify the hydrocracker conversion efficiency.

In another embodiment, a controller can be in electronic communication with, and adjust, adjust thermostats, pressure regulators, valves, feeders and/or pumps associated with, the optional recycle stream 159, 160, or both 159 and 160. In further embodiments, a controller can be in electronic communication with, and adjust, adjust thermostats, pressure regulators, valves, feeders and/or pumps associated with, the bleed stream 161. Accordingly, the amount of recycle to the reactors 120 and/or 170 can be controlled. The controller can provide such control in response to signals generated by operator data input and/or automatically retrieved data.

The system and controller of one or more embodiments of the integrated process provide a versatile unit having multiple modes of operation, which can respond to multiple inputs to increase the flexibility of the recovered product. The controller can be implemented using one or more computer systems which can be, for example, a general-purpose computer. Alternatively, the computer system can include specially-programmed, special-purpose hardware, for example, an application-specific integrated circuit (ASIC) or controllers intended for a particular unit operation within a refinery. The computer system can include one or more processors typically connected to one or more non-transitory memory devices, which can comprise, for example, any one or more of a disk drive memory, a flash memory device, a RAM memory device, or other device for storing data. The memory is typically used for storing programs and data during operation of the system. For example, the memory can be used for storing historical data relating to the parameters over a period of time, as well as operating data. Software, including programming code that implements embodiments of the invention, can be stored on a computer readable and/or writeable nonvolatile recording medium, and then typically copied into memory wherein it can then be executed by one or more processors. Such programming code can be written in any of a plurality of programming languages or combinations thereof. Components of the computer system can be coupled by one or more interconnection mechanisms, which can include one or more busses, for example, between components that are integrated within a same device, and/or a network, for example, between components that reside on separate discrete devices. The interconnection mechanism typically enables communications, for example, data, instructions, to be exchanged between components of the system. The computer system can also include one or more input devices, for example, a keyboard, mouse, trackball, microphone, touch screen, and other man-machine interface devices as well as one or more output devices, for example, a printing device, display screen, or speaker. In addition, the computer system can contain one or more interfaces that can connect the computer system to a communication network, in addition or as an alternative to the network that can be formed by one or more of the components of the system.

According to one or more embodiments of the integrated process, the one or more input devices can include sensors and/or flow meters for measuring any one or more parameters of the apparatus and/or unit operations thereof. In certain embodiments, said sensors and/or flow meters are provided to measure the flow rate at one or more of streams 122, 174, 176, 178, and/or 142 as shown in FIGS. 1 and 2, and streams 152, 154, 156, 158, 159, 160 and/or 161 as shown in FIG. 2.

Alternatively, one or more of the sensors, flow meters, pumps, or other components of the apparatus can be connected to a communication network that is operatively coupled to the computer system. Any one or more of the above can be coupled to another computer system or component to communicate with the computer system over one or more communication networks. Such a configuration permits any sensor or signal-generating device to be located at a significant distance from the computer system and/or allow any sensor to be located at a significant distance from any subsystem and/or the controller, while still providing data therebetween. Such communication mechanisms can be affected by utilizing any suitable technique including but not limited to those utilizing wireless protocols.

Although the computer system is described by way of example as one type of computer system upon which various aspects of the integrated process can be practiced, it should be appreciated that the invention is not limited to being implemented in software, or on the computer system as exemplarily described. Indeed, rather than implemented on, for example, a general purpose computer system, the controller, or components or subsections thereof, can alternatively be implemented as a dedicated system or as a dedicated programmable logic controller (PLC) or in a distributed control system. Further, it should be appreciated that one or more features or aspects of the integrated cracking apparatus can be implemented in software, hardware or firmware, or any combination thereof. For example, one or more segments of an algorithm executable by a controller can be performed in separate computers, which in turn, can be in communication through one or more networks.

In some embodiments, one or more sensors and/or flow meters can be included at locations throughout the integrated process, which are in communication with a manual operator and/or an automated control system to implement a suitable process modification in a programmable logic controlled integrated process. In one embodiment, an integrated process includes a controller which can be any suitable programmed or dedicated computer system, PLC, or distributed control system. The flow rates of certain product streams from the separation zone 170 and/or the light olefin production zone 150 can be measured, and flow can be redirected as necessary to meet the requisite product slate.

In certain embodiments, under control of an operator or a controller as described herein, the integrated process can operate with a reduced efficiency catalyst in the hydrotreating zone 120 to favor bottoms production, that is, having a level of activity that is conventionally considered unsuitable for use in their respective operations. For instance, catalysts can be selected so that conversion is such that the bottoms product is in the range of about 65-90, 65-80, 65-75, 70-90, 70-80 or 70-75 V % of the feed. In this manner, the quantity of feed to the light olefin production zone 150 is increased, thereby resulting in an increase in its products including light olefins.

In further embodiments, under control of an operator or a controller as described herein, the hydrotreating zone 120 can operate with a level of hydrogen feed that is relatively low, that is, at a level that is conventionally considered unsuitable for use in their respective operations. For instance, hydrogen levels can be selected so that conversion is such that the bottoms product is in the range of about 65-90, 65-80, 65-75, 70-90, 70-80 or 70-75 V % of the feed. In this manner, the expense of hydrogen is reduced, and the quantity of feed to the light olefin production zone 150 is increased, thereby resulting in an increase in its products including light olefins.

Factors that can result in various adjustments or controls include customer demand of the various hydrocarbon products, market value of the various petrochemical and hydrocarbon products, feedstock properties such as API gravity or heteroatom content, and product quality (for example, gasoline and mid distillate indicative properties such as octane number for gasoline and cetane number for mid distillates).

EXAMPLES

In order to ascertain the impact of DMO on product quality, a first feed of VGO alone, and a second feed containing VGO and 10 V % DMO, were compared in a pilot plant hydrocracking unit operating at a weighted average bed temperature of 396° C., a hydrogen partial pressure of 117.7 bars, a hydrogen to oil ratio of 800 StL/L, and a liquid hourly space velocity of 0.46 $h^{-1}$. Product quality deteriorates with the addition of DMO. It was observed that the sulfur contents of the first zone effluents and heavy diesel oil are higher when 10 V % DMO is included in the feedstream. When VGO alone is the feed, the sulfur in the first zone effluents is in the range of 50-150 ppm, and in the heavy diesel oil it was about 260 ppm. With the addition of 10 V % DMO for the second feed, this increased to about 200-300 ppm sulfur in the first zone effluents and about 340 ppm in the heavy diesel oil. In addition to product quality, the required operating temperature increased by 7° C. with incorporation of 10 V % DMO in the feedstock, equivalent to about 1.1° C. per 1.5 V % of DMO in the feedstock.

Example 1

A feedstock blend, containing 15 V % DMO and 85 V % VGO, more particularly 64 V % heavy VGO and 21 V % light VGO, was desulfurized. Properties of the blended feedstock are provided in Table 1. The hydrotreating reaction zone included a catalytic system consisting of amorphous support promoted with metals Ni, W and Mo, and operated at 112.8 bars hydrogen partial pressure, 800 $m^3$ of feedstock over 1000 $m^3$ of catalyst per hour (LHSV 0.8 $h^{-1}$), a hydrogen to oil ratio of 1,265 StL/L, and at a temperature range of 370-385° C.

The desulfurized feedstock was hydrogenated and hydrocracked in second reaction zone using a pilot plant hydrocracking unit containing a 5 W % framework-substituted zeolite and 95 W % alumina support with about 0.2 W % Pt as the active metal component, and operated at 80 bars hydrogen partial pressure, 1000 $m^3$ of feedstock over 1000 $m^3$ of catalyst per hour (LHSV 1 $h^{-1}$), a hydrogen to oil ratio of 1000 StL/L, and at temperature range of 300-360° C. The material balance for the overall process is set forth in Table 2.

TABLE 1

Properties of Feedstock and its components

| Property | Unit | Method | Blend |
|---|---|---|---|
| Specific Gravity | | | 0.918 |
| API Gravity | ° | ASTM D4052 | 22.6 |
| Sulfur | W % | ASTM D5453 | 2.2 |
| Nitrogen | ppmw | ASTM D5762 | 751 |
| Bromine Number | g/100 g | | 3.0 |
| Hydrogen | W % | ASTM D4808 | 12.02 |
| Simulated Distillation | | ASTM D7213 | |
| IBP | ° C. | | 210 |
| 10/30 | ° C. | | 344/411 |
| 50/70 | ° C. | | 451/498 |
| 90/95 | ° C. | | 590/655 |
| 98 | ° C. | | 719 |
| Sulfur DBE (max) | | FT-ICR MS | 31 |
| Nitrogen DBE (max) | | FT-ICR MS | 31 |
| Hydrocarbons DBE (max) | | FT-ICR MS | 32 |

TABLE 2

Material Balance

| Property | Unit | 102 | 104 | 122 | 172 + 174 | 176 | 106 | 142 |
|---|---|---|---|---|---|---|---|---|
| Flow Rate | Kg/h | 1,000.0 | 107.9 | 1,013.9 | 271.9 | 742.0 | 80.0 | 691.9 |
| Specific Gravity | | 0.918 | | | | | | |
| Sulfur, ppmw | | 22,000 | | 5 | | | | |
| Nitrogen, ppmw | | 751.0 | | 5 | | | | |
| Aromatic Carbon | W % | 20.0 | | 14.4 | | | | 3.6 |
| $H_2$ Pressure | Barg | | | 114.7 | | | | |
| LHSV | $h^{-1}$ | | | 1.3 | | | | |
| $H_2$/oil | StL/L | | | 1,336 | | | | |
| WABT | ° C. | | | 346.2 | | | | |
| Conversion | W % | | | 16.8 | | | | |
| $H_2S + NH_3$ | Kg/h | — | | 25.4 | 25.4 | | | |
| Distillates ( >370° C.) | Kg/h | 108 | | 246.5 | 246.5 | | | 55.7 |
| Unconverted Bottoms | Kg/h | 89.2 | | 742.0 | | 742.0 | | |
| Hydrogenated Bottoms | Kg/h | | | | | | | 632.6 |
| Total Yield | Kg/h | 100.0 | | 1,013.9 | 271.9 | 742.0 | | 691.9 |
| Hydrogen consumption | W % of feed | | | 1.4 | | | | 0.8 |

The operation yielded about 69 W % of a hydrogen-rich, aromatic lean stream from the fractionator bottoms. This effluent is suitable for use as a feedstream in an olefin production process, or for use as a lubricant base oil. Table 3 sets forth details regarding the aromatic-lean hydrogenated effluent 142. The properties for the hydrogenated effluent bottoms 142 are particularly desirable as a feed for steam cracking and fluid catalytic cracking operations, since C—C cleavage in paraffinic and naphthenic compounds readily occurs, but very stable aromatic bonds hinder C—C cleavage in those aromatic compounds.

TABLE 3

Properties of Hydrogenated Bottoms Effluent

| Property | Unit | Value |
|---|---|---|
| Density @ 15° C. | g/cc | 0.861 |
| Hydrogen | W % | >14.0 |
| Sulfur | ppmw | <500 |

TABLE 3-continued

Properties of Hydrogenated Bottoms Effluent

| Property | Unit | Value |
|---|---|---|
| Nitrogen | ppmw | <5 |
| Saturates | W % | 98.2 |
| Aromatics | W % | 1.8 |
| Simulated Distillation | | |
| IBP | ° C. | 160 |
| 5% | ° C. | 358 |
| 25% | ° C. | 390 |
| 50% | ° C. | 424 |
| 90% | ° C. | 488 |
| FBP | ° C. | 507 |

Example 2

Advanced Catalyst Evaluation (ACE) tests were conducted using hydrogenated vacuum gas oil as a fluidized catalytic cracking feed. The test was conducted with the USY zeolite catalyst including an additive (10% of the total catalyst mass). The additive is a commercially available ZSM-5 based additive to enhance the propylene yields. The tests were carried-out at 600° C., suitable for FCC propylene production, using a catalyst to oil ratio of 4:1 and at a residence time of 60 seconds. Liquid and gas products were collected and analyzed using gas chromatography. Conversion and products yields were calculated on mass basis.

After completion of the ACE tests, the catalyst sample was collected from the testing reactor and the amount of solid coke deposits was measured. Gas products were analyzed for the following components: hydrogen, methane, ethane, propane, propylene, iso- and normal-butane, and butenes. Liquid products were analyzed for the following components: gasoline, which has a boiling range from pentane boiling point to 216° C., light cycle oil (LCO), which has a boiling point range from 216° C. to 343° C., and heavy cycle oil (HCO), which has a boiling point of 343° C. and higher, denoted as 343+ fraction. Table 4 sets forth the product yields.

TABLE 4

| ACE Test Product Yields | | | |
|---|---|---|---|
| Products | Stream # | W % | Product, Kg/day |
| Hydrogen | 151 | 0.10 | 0.61 |
| Methane | 151 | 0.90 | 5.56 |
| Ethylene | 152 | 5.50 | 34.78 |
| Ethane | 152 | 0.73 | 4.62 |
| Propylene | 152 | 25.90 | 163.87 |
| Propane | 152 | 2.90 | 18.33 |
| Isobutane | 152 | 4.74 | 29.96 |
| Isobutylene | 152 | 8.04 | 50.83 |
| 1-Butene | 152 | 3.76 | 23.78 |
| 1,3 Butadiene | 152 | 0.11 | 0.72 |
| n-Butane | 152 | 1.53 | 9.70 |
| t-2-Butene | 152 | 5.64 | 35.67 |
| c-2-Butene | 152 | 4.14 | 26.16 |
| Gasoline | 154 | 24.53 | 155.18 |
| LCO | 156 | 4.87 | 30.79 |
| HCO | 156 | 5.22 | 33.02 |
| Coke | 158 | 1.43 | 9.02 |
| Total | | 100.00 | 632.6 |

The method and system of the present invention have been described above and in the attached drawings; however, modifications will be apparent to those of ordinary skill in the art and the scope of protection for the invention is to be defined by the claims that follow.

The invention claimed is:

1. A process for deep hydrogenation of a heavy oil feedstream including demetallized oil and/or deasphalted oil, the process comprising:

a. reacting the heavy oil feedstream in the presence of hydrogen and a hydrotreating catalyst in a first reaction zone to produce a first reaction zone effluent stream, said first reaction zone including one or more reactors operating under conditions effective for desulfurization and denitrogenation of the feedstock and to produce the first reaction zone effluent stream having a conversion level in the range of about 15-70 V %;

b. fractionating the first reaction zone effluent stream into at least a tops stream and a bottoms streams, wherein the tops stream comprises $C_1$-$C_4$ hydrocarbons, naphtha and middle distillates, and the bottoms stream comprises hydrocarbon components having an initial nominal boiling point in the range of about 320-400° C.;

c. hydrogenating the bottoms stream in the presence of a deep hydrogenation catalyst in a second reaction zone to produce a second reaction zone effluent stream, said second reaction zone including one or more reactors operating under conditions effective to produce the second reaction zone effluent stream having an aromatic saturation level of at least about 90 W % of the feedstock aromatics.

2. The process as in claim 1, wherein said first reaction zone contains one or more fixed-bed, ebullated-bed, slurry-bed, or moving bed reactors.

3. The process as in claim 1, wherein said first reaction zone operates under conditions effective to produce the first effluent stream including a reaction temperature in the range of 300° C. to 500° C., hydrogen partial pressure in the range of 60-300 bars; hydrogen feed rate up to 2500 StL/L of hydrocarbon feed; and a liquid hourly space velocity in the range of 0.1 $h^{-1}$ to 10 $h^{-1}$.

4. The process as in claim 1, wherein the heavy oil feedstream comprises at least about 7.5 V % of demetallized oil or deasphalted oil.

5. The process as in claim 1, wherein the first reaction zone contains hydrotreating catalyst containing one or more active metal components selected from the group consisting of Group 6-10 metals from the IUPAC Periodic Table of the Elements.

6. The process as in claim 5, wherein the active metal component of the hydrotreating catalyst contained in the first reaction zone is unsupported, in sulfide form, and is selected from the group consisting of nickel, cobalt, molybdenum, tungsten, and combinations thereof.

7. The process as in claim 5, wherein the active metal component of the hydrotreating catalyst contained in the first reaction zone is selected from the group consisting of cobalt, nickel, tungsten, molybdenum and combinations thereof, wherein the active metal component of the hydrotreating catalyst contained in the first reaction zone is deposited or incorporated on a support selected from the group consisting of amorphous alumina, amorphous silica alumina, zeolites and combinations thereof.

8. The process as in claim 5, wherein the active metal component of the hydrotreating catalyst contained in the first reaction zone is a combination of active metal components selected from the group consisting of nickel/tungsten/molybdenum, cobalt/molybdenum, nickel/molybdenum, nickel/tungsten and cobalt/nickel/molybdenum.

9. The process as in claim 8, wherein the active metal component of the hydrotreating catalyst contained in the first reaction zone is contained in a bed of catalyst containing cobalt/molybdenum as the active metal species and a bed of catalyst containing nickel/molybdenum as the active metal species.

10. The process as in claim 1, wherein the second reaction zone contains one or more fixed-bed, ebullated-bed, slurry-bed or moving bed reactors.

11. The process as in claim 1, wherein said second reaction zone operates under conditions effective for deep hydrogenation and to produce the second effluent stream having a level of aromatic saturation of at least 90 W % of the feedstock aromatics, wherein said conditions comprise a reaction temperature in the range of 250° C. to 450° C., a hydrogen partial pressure in the range of 30-200 bars, a hydrogen feed rate up to 2500 StL/L of hydrocarbon feed and a feed rate in the range of 0.1 $h^{-1}$ to 5 $h^{-1}$.

12. The process as in claim 11, wherein the second reaction zone contains deep hydrogenation catalyst containing one or more active metal components selected from the group consisting of Group 7-10 metals from the IUPAC the Periodic Table of the Elements.

13. The process as in claim 12, wherein the active metal component of the deep hydrogenation catalyst contained in the second reaction zone is selected from the group consisting of platinum, palladium, titanium, rhodium, rhenium, iridium, ruthenium, nickel, cobalt and combinations thereof.

14. The process as in claim 13, wherein the deep hydrogenation catalyst contained in the second reaction zone comprises an amorphous alumina supported active metal component.

15. The process as in claim 13, wherein the deep hydrogenation catalyst contained in the second reaction zone comprises a non-acidic amorphous alumina supported active metal component.

16. The process as in claim 13, wherein the deep hydrogenation catalyst contained in the second reaction zone comprises a supported active metal component, wherein the support comprises non-acidic amorphous alumina and 0.5-30 W % zeolite.

17. The process as in claim 13, wherein the deep hydrogenation catalyst contained in the second reaction zone comprises a non-acidic supported noble metal catalyst.

18. The process as in claim 13, wherein the deep hydrogenation catalyst contained in the second reaction zone comprises a supported platinum, palladium or both platinum and palladium catalyst, wherein the support comprises a non-acidic support.

19. The process as in claim 13, wherein the deep hydrogenation catalyst contained in the second reaction zone comprises a USY zeolite supported platinum catalyst.

20. The process as in claim 13, wherein the deep hydrogenation catalyst contained in the second reaction zone includes a modified USY zeolite support having one or more of Ti, Zr and/or Hf substituting the aluminum atoms constituting the zeolite framework thereof.

21. The process as in claim 1, wherein an operating temperature in the second reaction zone is in the range of 30° C. to 80° C. less than the operating temperature in the first reaction zone.

22. The process as in claim 1, wherein the second effluent stream is passed to a light olefin production zone to produce light gases, recovered products and bottoms, wherein at least a portion of the bottoms are recycled to the first reaction zone, the second reaction zone or both the first and second reaction zone.

23. The process as in claim 22, wherein the light olefin production zone is a fluidized catalytic cracking zone or a high severity fluidized catalytic cracking zone, wherein the recycled bottoms include full range, light and/or heavy cycle oil.

24. The process as in claim 22, wherein the light olefin production zone is steam cracking, wherein the recycled bottoms include full range, light and/or heavy pyrolysis oil.

25. The process as in claim 22, wherein substantially all of the bottoms are recycled.

26. The process as in claim 1, wherein conversion in the first reaction zone operates under flexible conditions whereby if there is an increased demand for distillates, the first reaction zone operates with a level of conversion in a first range of about 30-70 V %, and if there is an increased demand for feedstocks for olefin production processes by steam cracking or fluid catalytic cracking, or feedstocks for lubricant base oil production, the first reaction zone operates with a level of conversion in a second range of about 15-35 V %.

27. The process as in claim 26, wherein catalysts of reduced activity are used in to operate with a level of conversion in the second range.

28. The process as in claim 26, wherein hydrotreating catalysts of reduced activity are used in to operate with a level of conversion in the second range.

* * * * *